US008051827B1

(12) United States Patent
Pien et al.

(10) Patent No.: US 8,051,827 B1
(45) Date of Patent: Nov. 8, 2011

(54) APPLYING THE LAW OF CONSERVATION OF ENERGY TO THE ANALYSIS AND DESIGN OF INTERNAL COMBUSTION ENGINES

(76) Inventors: Pao Chi Pien, Chevy Chase, MD (US); Paul Shih-Hsi Pien, Bethesda, MD (US)

( * ) Notice: Subject to any disclaimer, the term of this patent is extended or adjusted under 35 U.S.C. 154(b) by 0 days.

(21) Appl. No.: 12/950,767

(22) Filed: Nov. 19, 2010

(51) Int. Cl.
*F02B 17/00* (2006.01)
*F02B 75/04* (2006.01)

(52) U.S. Cl. ..... 123/295; 123/311; 123/316

(58) Field of Classification Search ..... 123/48 R, 123/48 A, 48 AA, 48 B, 48 D, 78 R, 78 A, 123/78 AA, 78 B, 78 BA, 78 D, 78 E, 78 F, 123/295, 305, 311, 316; 701/101–103
See application file for complete search history.

(56) References Cited

U.S. PATENT DOCUMENTS

| | | | | |
|---|---|---|---|---|
| 2,292,233 | A | | 8/1942 | Lysholm |
| 2,820,339 | A | | 1/1958 | Grieshaber et al. |
| 2,917,031 | A | | 12/1959 | Nestorovic |
| 3,093,959 | A | | 6/1963 | Birmann |
| 3,125,076 | A | | 3/1964 | Mullaney |
| 3,623,463 | A | | 11/1971 | De Vries |
| 3,672,160 | A | | 6/1972 | Kim |
| 3,808,818 | A | | 5/1974 | Cataldo |
| 3,924,576 | A | | 12/1975 | Siewert |
| 4,023,365 | A | | 5/1977 | van Ginhoven |
| 4,050,420 | A | | 9/1977 | Cataldo |
| 4,280,468 | A | | 7/1981 | Millman |
| 4,520,765 | A | | 6/1985 | Gerace |
| 4,541,246 | A | | 9/1985 | Chang |
| 4,663,938 | A | | 5/1987 | Colgate |
| 4,783,966 | A | | 11/1988 | Aldrich |
| 4,815,423 | A | | 3/1989 | Holmer |
| 4,918,923 | A | | 4/1990 | Woollenweber et al. |
| 5,033,418 | A | | 7/1991 | Maissant et al. |
| 5,117,788 | A | | 6/1992 | Blaser |
| 5,228,415 | A | | 7/1993 | Williams |
| 5,265,562 | A | | 11/1993 | Kruse |
| 5,311,739 | A | | 5/1994 | Clark |
| 5,341,771 | A | | 8/1994 | Riley |
| 5,460,128 | A | | 10/1995 | Kruse |
| 5,566,650 | A | | 10/1996 | Kruse |
| 5,665,272 | A | | 9/1997 | Adams et al. |
| 6,058,904 | A | | 5/2000 | Kruse |
| 6,125,801 | A | * | 10/2000 | Mendler ..... 123/48 R |
| 6,223,846 | B1 | | 5/2001 | Schechter |
| 6,323,463 | B1 | | 11/2001 | Davis et al. |
| 6,405,704 | B2 | | 6/2002 | Kruse |
| 6,457,309 | B1 | | 10/2002 | Firey |
| 6,481,206 | B1 | | 11/2002 | Pien |
| 6,848,416 | B1 | | 2/2005 | Pien |

(Continued)

OTHER PUBLICATIONS

Heywood, John B. (1988) *Internal Combustion Engine Fundamentals*. McGraw-Hill, pp. 183-186.

*Primary Examiner* — Willis Wolfe, Jr.
(74) *Attorney, Agent, or Firm* — Steptoe & Johnson LLP

(57) ABSTRACT

A method for designing internal combustion engines can include selecting a compression ratio that produces a compression temperature just below the autoignition temperature of a fuel/air mixture, selecting a fuel equivalence ratio that produces a combustion temperature below the threshold temperature at which NOx formation or autoignition of the mixture occurs, and selecting an expansion ratio greater than the compression ratio.

19 Claims, 1 Drawing Sheet

U.S. PATENT DOCUMENTS

| | | | | |
|---|---|---|---|---|
| 6,951,211 | B2 | 10/2005 | Bryant | |
| 7,114,485 | B2 | 10/2006 | Pien | |
| 7,360,509 | B2 * | 4/2008 | Hashimoto et al. | 123/27 R |
| 7,438,025 | B2 | 10/2008 | Yang | |
| 2003/0136356 | A1 | 7/2003 | Namkung | |
| 2004/0244732 | A1 | 12/2004 | Kojic et al. | |
| 2007/0017200 | A1 * | 1/2007 | Zajac | 60/39.6 |
| 2009/0056687 | A1 * | 3/2009 | Pien | 123/73 R |
| 2009/0125211 | A1 | 5/2009 | Akihisa et al. | |

* cited by examiner

APPLYING THE LAW OF CONSERVATION OF ENERGY TO THE ANALYSIS AND DESIGN OF INTERNAL COMBUSTION ENGINES

TECHNICAL FIELD

The present invention relates to internal combustion engines and methods for operating and designing internal combustion engines.

BACKGROUND

Internal combustion engines convert fuel chemical energy into heat energy during a combustion process. A significant portion of converted heat energy can be lost to a cooling system surrounding the combustion chamber and the remaining portion can be transformed into the internal energy of products of combustion as measured by the temperature increase. During an expansion process, a portion of the internal energy of working fluid is transformed into mechanical work and the remainder is rejected with exhaust gas at the end of the expansion process. To improve the fuel efficiency, it is necessary to reduce energy loss to the cooling system and to reduce internal energy of exhaust gases.

Currently, when designing and developing an internal combustion engine, emissions and thermodynamic performance characteristics are approached as being closely intertwined, which unnecessarily complicates the process. The complexity of the current approach can obscure the true simplicity of the thermodynamic aspects of the internal combustion engine. It is desirable to develop a simplified approach for analyzing and designing engines that isolates and untangles these disparate and independent characteristics to facilitate the development of internal combustion engines with enhanced efficiency and lower emissions.

SUMMARY

Generally, the law of conservation of energy is not directly applied in the evaluation of thermodynamic performance of internal combustion engines. Properly expressed, the law of conservation of energy provides a simple and straightforward tool for evaluating the thermodynamic performance of internal combustion engines and for designing engines to maximize fuel economy and minimize emissions.

A new formulation and alternate expression of the law of conservation of energy has been derived. The new equation vastly simplifies the evaluation of the thermodynamic performance of internal combustion engines and provides a new tool in the design of high efficiency internal combustion engines as well as the redesign of existing internal combustion engines. The application of the equation has led to the design of new engines with high expansion ratios, with compression ratios selected independent of the expansion ratio, and that operate at one-third or lower loading to meet the full range of operating requirements. These new engines have greatly improved thermodynamic performance, translating to substantially improved fuel economy, as well as reduced emissions.

Currently, the ideal air cycle is the only simple model for simulating the performance of a reciprocating internal combustion engine. The ideal air cycle, however, requires that the piston movement be very slow so that the working fluid temperature, pressure, and specific volume are continuously reaching equilibrium. In reality, there is insufficient time for the working fluid properties to reach equilibrium, so equilibrium thermodynamics cannot be applied. In the absence of a more useful workable model, engine researchers rely on complex simulation models and/or complicated and expensive engine testing setups. The law of conservation of energy, which states that energy can neither be created nor destroyed, provides a straightforward method for evaluating and modeling the thermodynamic performance of internal combustion engines. The law of conservation of energy also provides the basis for developing a new methodology for designing internal combustion engines.

For an isentropic process, the law of conservation of energy is commonly expressed by the first law of thermodynamics as $$T_2/T_1=(V_1/V_2)^{k-1} \quad \text{(Eq. 1)}$$

where $T_1$ and $V_1$ are the temperature and volume at a first state, $T_2$ and $V_2$ are the temperature and volume at a second state, and k is the specific heat ratio of air. By replacing $T_1$ and $T_2$ with $E_1/c_v$ and $E_2/c_v$, respectively, throughout the gas volume, an internal energy distribution is obtained in place of the temperature distribution. Accordingly, Eq. 1 becomes $$(E_2/c_v)/(E_1/c_v)=(V_1/V_2)^{k-1} \quad \text{(Eq. 2)}$$

where $c_v$ is the specific heat of air for a constant volume process. By canceling the specific heat values in the numerator and denominator, Eq. 2 can be simplified to $$E_2/E_1=(V_1/V_2)^{k-1} \quad \text{(Eq. 3)}$$

This new expression of the law of conservation of energy (hereinafter referred to as the "Conservation of Energy Equation") sets forth a simple and accurate expression for the transformation of mechanical work that occurs when changing the cylinder volume from $V_1$ to $V_2$ into cylinder gas internal energy when $V_1$ is greater than $V_2$. When $V_1$ is less than $V_2$, cylinder gas internal energy is transformed into mechanical work.

To illustrate the application of the Conservation of Energy Equation, three examples are presented below where the combustion process is represented as either a constant volume process or a constant pressure process. First, an engine cycle having a constant-volume combustion process is considered for an engine having a compression ratio of 14.5. The engine cycle includes four states having a sequence of 1-2-3-4-1. At state 1, the volume $V_1$ is 15.6 $ft^3$ for one pound of air, the temperature $T_1$ is 311° K, and the internal energy $E_1$ is 95.73 BTU (where $E_1$ is the product of $c_v$ and $T_1$). A compression process 1-2 reduces the cylinder volume from $V_1$ to $V_2$. At state 2, the volume $V_2$ is 1.076 $ft^3$ and the internal energy $E_2=E_1\ (V_1/V_3)^{k-1}=279$ BTU. A properly timed spark initiates a constant volume combustion process 2-3. At the end of the combustion process 2-3, the internal energy $E_3=(E_2+Q)$, where Q represents a heat addition of 400 BTU at one-third load. Accordingly, the internal energy $E_3=279+400=679$ BTU. At the end of an expansion process 3-4, the volume $V_4=15.6$ $ft^3$ and the internal energy $E_4=E_3\ (V_3/V_4)^{k-1}=233$ BTU. The indicated efficiency $n_t$ is equal to $(E_3-E_4)/E_3=(679-233)/679.0=65.7\%$.

Next, a second engine cycle also having a constant volume combustion process is considered for an engine having a compression ratio of 9.3. The engine cycle includes four states having a sequence 1-2-3-4-1. A compression process 1-2 starts with volume $V_1=10.0$ $ft^3$ and ends with volume $V_2=1.076$ $ft^3$. At state 1, the internal energy $E_1$ is 95.73 BTU (where $E_1$ is the product of $c_v$ and $T_1$). At state 2, $E_2=E_1\ (V_1/V_2)^{k-1}=95.73\ (10.0/1.076)^{0.4}=233.5$ BTU. A constant volume combustion process 2-3 is represented by a heat addition Q of 400 BTU at one-third load. Therefore, the internal energy at state 3 is equal to $E_2+Q=233.5+400=633.5$ BTU.

An expansion process 3-4 returns the volume to 15.6 $ft^3$ where $E_4=E_3\ (V_3/V_4)^{k-1}=633.5(1.076/15.6)0.4=217.4$ BTU. Accordingly, the thermal efficiency $n_t=(E_3-E_4)/E_3=(633.5-217.4)/633.5=65.7\%$.

Finally, a third engine cycle having a constant pressure combustion process is considered. The specific heat at constant pressure $c_p$ is used for the calculation (instead of $c_v$ as used in the previous two cycles) and results in the internal energy increase from 2-3 being reduced by a factor of 1.4 when compared to the previous example. At the end of the combustion process, $E_3=E_2+(400/1.4)=564.7$ and $V_3=V_2(564.7/279.0)=2.18$ $ft^3$. At state 4, $E_4=E_3(2.18/15.6)^{0.4}=257.0$ BTU. Accordingly, the thermal efficiency $n_t=(679.0-257.0)/679=62.2\%$.

Application of the Conservation of Energy Equation to the foregoing three cases with different compression and expansion ratios illustrates the simplicity of the new equation. In addition, it shows that indicated efficiency of an engine is determined by the expansion ratio and that indicated efficiency is independent of the compression ratio. Traditionally, engine researchers and designers have tied indicated efficiency to the compression ratio. By clearly showing that indicated efficiency is determined mainly by an engine's expansion ratio and is independent of its compression ratio, the Conservation of Energy Equation provides the impetus for developing a new approach to designing internal combustion engines and serves as an essential tool allowing the thermodynamic performance of any particular design to be quickly and accurately calculated.

In analyzing the thermodynamic performance of an internal combustion engine, only the compression, combustion, and expansion processes affect thermodynamic performance. During the compression process, mechanical work is transformed into internal energy of the working fluid. During the combustion process, chemical energy in fuel is converted into heat energy. A significant portion of the converted heat energy is transformed into coolant load (hereinafter referred to as "combustion loss"), and the remainder of the heat energy is transformed into internal energy of working fluid as measured by the temperature of the combustion products. During an expansion process, a portion of the internal energy of working fluid is transformed into mechanical work. The remaining internal energy of working fluid is lost through the exhaust gas. Due to friction between the moving piston and the cylinder wall, a small portion of mechanical work is transformed into coolant load or lost as exhaust gas internal energy (hereinafter referred to as "friction loss").

Thus, to improve the thermodynamic performance (and fuel efficiency) of an internal combustion engine, there are only three direct ways to improve performance: (i) reduce combustion loss; (ii) reduce friction loss; and/or (iii) reduce the exhaust gas internal energy. Although combustion loss is much greater than friction loss, the prevailing approach for increasing fuel efficiency is to increase engine power density (often using a turbocharger) so that the friction loss per unit power output is smaller. The law of conservation of energy as expressed by the Conservation of Energy Equation demonstrates that the most effective and direct approach to increase thermodynamic performance, and thereby increase fuel efficiency, is to reduce the internal energy of the exhaust gas and the amount of combustion loss by designing the compression, combustion, and expansion processes to achieve these goals. More specifically, the expansion ratio (both actual and effective) determines the indicated efficiency. The compression ratio and fuel equivalence ratio determine combustion temperature, which controls combustion loss.

Additionally, by recognizing that the compression ratio and expansion ratio are independent of each other, engine designers are afforded unprecedented flexibility in creating new engine thermodynamic designs. For example, since the compression ratio controls the temperature of the cylinder gases at the end of the compression stroke (hereinafter referred to as "compression temperature"), it may be desirable to achieve a compression temperature that is very close to, but slightly below, the mixture's autoignition temperature by selecting a compression ratio that produces the desired compression temperature. By controlling the compression temperature of the fuel-air mixture, combustion can be triggered by a spark to obtain spark-assisted homogenous charge compression ignition (HCCI)-like combustion. By operating at a compression temperature that is slightly below the mixture's autoignition temperature, auto-ignition is avoided and combustion timing can be carefully controlled with spark timing.

By showing definitively that the expansion ratio and compression ratio of an engine are independent of each other, the Conservation of Energy Equation has facilitated the development of a new method for designing an engine that maximizes thermodynamic performance and minimizes emissions. Recognizing that the compression, expansion, as well as the combustion processes are independent from each other for purposes of designing and evaluating thermodynamic performance, the new methodology involves determining the optimum mix of the engine's compression, expansion, and fuel equivalence ratios (referred to as the "Three Ratios Methodology"). By greatly simplifying the process for designing and evaluating the thermodynamic performance of a particular engine design, the Three Ratios Methodology together with the Conservation of Energy Equation have facilitated the development of a completely new approach for producing ultra high efficiency, clean burning internal combustion engines.

Methods for designing and operating a new engine are described herein. The methods focus primarily on increasing the overall efficiency of the engine. Overall efficiency may be improved, in part, by selecting (i) a compression ratio for reaching a required compression temperature (that avoids autoignition) such that combustion can be controlled by spark timing, (ii) an equivalence ratio that controls combustion temperature, and (iii) an expansion ratio (both real and effective) that maximizes indicated efficiency. As described below, the compression ratio, equivalence ratio, and expansion ratio, are carefully balanced to reduce combustion loss and friction loss, and to maximize indicated efficiency to produce an engine capable of high fuel efficiency and low emissions.

DETAILED DESCRIPTION

Figure 1:
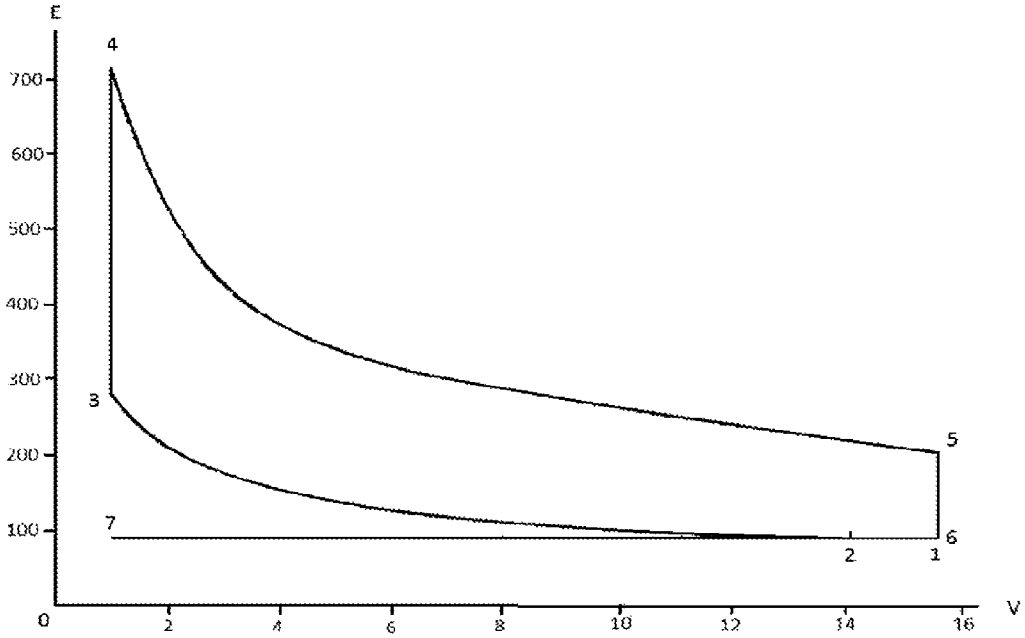
FIG. 1 is a plot of internal energy versus volume for a four-stroke overexpanded HCSI engine.

The invention summarized above and defined by the enumerated claims may be better understood by referring to the following description, which should be read in conjunction with the accompanying figures. This description of an embodiment, set out below to enable one to build and use an implementation of the invention, is not intended to limit the enumerated claims, but to serve as a particular example thereof. Those skilled in the art should appreciate that they may readily use the conception and specific embodiments disclosed as a basis for modifying or designing other methods and systems for carrying out the same purposes of the present invention. Those skilled in the art should also realize that such equivalent assemblies do not depart from the spirit and scope of the invention in its broadest form.

The Conservation of Energy Equation provides an invaluable tool/methodology for designing internal combustion engines to maximize fuel efficiency while minimizing emissions. By allowing an engine's thermodynamic characteristics and performance to be quickly and accurately calculated, the Conservation of Energy Equation provides the impetus for the creation of a new methodology for designing internal combustion engines. The application of the Equation to evaluate the thermodynamic performance of a variety of engine designs shows clearly that the compression, combustion, and expansion processes for design purposes can be separated and treated independent of each other.

The new methodology for designing internal combustion engines has a wide range of applicability, including four-stroke and two-stroke configurations. In addition, the new methodology can be applied to guide the development of criteria for modifying existing engines to achieve the benefits of higher indicated efficiency from higher expansion ratios while at the same time reducing combustion loss. The new methodology (or aspects thereof) can be applied to existing or future internal combustion engines.

Utilizing the capabilities of the Conservation of Energy Equation, the Three Ratios Methodology for designing internal combustion engines has been created. Under this new methodology, engine designers separately select the desired compression, fuel equivalence, and expansion ratios. The Conservation of Energy Equation quickly and accurately computes the overall thermodynamic performance of the combination of the chosen compression, fuel equivalence and expansion ratio parameters. Moreover, once the base compression, fuel equivalence and expansion ratios have been selected, additional engine design elements/refinements can be considered for further enhancing the overall thermodynamic performance of the engine (referred to herein as "Secondary Design Elements").

There are only three direct ways to increase the thermodynamic efficiency of existing internal combustion engines. To increase efficiency, engine designers must find a way to reduce combustion loss, friction loss, and/or the internal energy of exhaust gases. Since combustion loss and the internal energy of exhaust gases are significantly larger than friction loss, it is logical to focus on reducing losses in those two areas. Based on the foregoing, the Three Ratios Methodology has been applied to the task of designing a new internal combustion engine that is capable of achieving unprecedented gains in thermodynamic efficiency.

With the ability to select a compression ratio independent of the expansion ratio, it is possible to select a compression ratio that provides a compression temperature just below the autoignition temperature of the fuel air mixture and to control ignition timing by employing a spark to create HCCI-like combustion (referred to herein as Homogeneous Charge Spark Ignition (HCSI). The temperature at which autoignition occurs is dependent on the fuel type and the cylinder pressure at or near the end of the compression stroke. For example, if the fuel is gasoline, the temperature at which autoignition would occur at a cylinder pressure corresponding to the end of the compression stroke may be about 900° K. Therefore, if gasoline is selected as the fuel, a desirable compression temperature to avoid autoignition may range from 800 to 900° K, or, more preferably, may range from 850 to 900° K. If the fuel includes ethanol, methanol, gasoline, diesel, or any other fuel or combination of fuels, the target compression temperature should be adjusted accordingly to avoid autoignition.

Next, an equivalence ratio has been selected that greatly reduces combustion temperature as compared with existing engines to reduce combustion loss. By reducing the difference between the combustion temperature and the temperature of the combustion chamber wall, the amount of heat energy lost to coolant load is greatly reduced. In addition, so long as the combustion temperature is below 1600° K, NOx formation will be avoided.

Finally, a desired high expansion ratio is selected based on, for example, indicated efficiency and specific engine weight. Selecting the compression ratio first, followed by the equivalence ratio and expansion ratio is a logical order for designing this particular internal combustion engine. Nevertheless, the Three Ratios Methodology can be applied to select the ratios in any order.

Thus, the basic characteristics of a newly designed engine include: (i) a compression ratio necessary to achieve a compression temperature just below the autoignition temperature of the fuel/air mixture, (ii) an equivalence ratio of no more than about 0.334 to limit combustion temperature; and (iii) a high expansion ratio. The corresponding impacts/benefits of these basic parameters are: (i) HCCI-like combustion, (ii) greatly reduced combustion loss and emissions; and (iii) a significantly higher indicated efficiency.

By operating the engine at one-third or lower loading, combustion temperature will be well below the temperature at which conventional engines operate. By greatly reducing the temperature differential between the cylinder wall and combustion temperature, combustion loss will be greatly reduced. A Secondary Design Element is selecting an equivalence ratio of 0.334 or lower so that the products of combustion will have a large percentage of excess air. Since air has a relatively large ratio between $c_p$ and $c_v$, the effect of operating at 0.334 or lower equivalence ratio is to increase the effective expansion ratio, further reducing the internal energy of the exhaust gas. The increase in the effective expansion ratio is estimated to be in excess of 7%.

To implement the identified characteristics necessary to improve thermodynamic efficiency of existing internal combustion engines, new four-stroke and two-stroke engines have been conceived. Both the four-stroke and two-stroke engines feature a compression ratio that produces a compression temperature just below the autoignition temperature of the fuel/air mixture for HCCI-like combustion, a fuel equivalence ratio of about 0.334 to maintain a combustion temperature below 1600° K, and an expansion ratio larger than the compression ratio. More detailed discussion of both of these new overexpanded homogeneous charge spark ignition (HCSI) engines follows. General aspects of overexpanded HCSI engines are described in U.S. Pat. No. 7,640,911, which is herein incorporated by reference in its entirety.

FIG. 1 is the E-V diagram of a four-stroke overexpanded HCSI engine cycle. The cylinder has a total volume of 15.6 $ft^3$ and a clearance volume of 0.975 $ft^3$. A compression stroke begins at point 1 with open intake valve and closed exhaust valve. The intake valve closes at $V_2$=14.14 $ft^3$ ($E_2$=$E_1$) to obtain a compression ratio of 14.5 to attain the required compression temperature at the end of compression process 2-3. During compression process 2-3, fuel is injected to the cylinder. Because of the very high compression temperature, injected fuel evaporates quickly and mixes with hot air to form a homogeneous charge. At point 3, $E_3=E_2(V_2/V_3)^{k-1}$ an HCCI-like combustion process 3-4 takes place initiated by a properly timed spark. At point 4, $E_4=E_3+Q$ where Q is equal to the mass of fuel multiplied by the lower heating value of the fuel. Expansion process 4-5 reduces $E_4$ to $E_5$ with $E_5=E_4(V_4/V_5)^{k-1}$. A blowdown process 5-6 and exhaust process 6-7 rejects $E_5$ from the cylinder. An intake process 7-1 completes the cycle.

The Conservation of Energy Equation has been applied to perform a thermodynamic analysis of a four-stroke overexpanded HCSI engine operating at one-third or lower loading. Table 1 presents the results of the analysis:

TABLE 1

| ϵ | 1 | 2 | 3 | 4 | 5 | 6 | 7 | 8 |
|---|---|---|---|---|---|---|---|---|
| 1 | Q | 40 | 60 | 80 | 100 | 120 | 140 | 400 |
| 2 | ϕ | 0.033 | 0.05 | 0.067 | 0.083 | 0.1 | 0.117 | 0.333 |
| 3 | Re | 16 | 16 | 16 | 16 | 16 | 16 | 16 |
| 4 | $V_3$ | 0.975 | 0.975 | 0.975 | 0.975 | 0.975 | 0.975 | 0.975 |
| 5 | $R_c$ | 14.5 | 14.5 | 14.5 | 14.5 | 14.5 | 14.5 | 14.5 |
| 6 | $V_2$ | 14.14 | 14.14 | 14.14 | 14.14 | 14.14 | 14.14 | 14.14 |
| 7 | $E_2$ | 95.7 | 95.7 | 95.7 | 95.7 | 95.7 | 95.7 | 95.7 |
| 8 | $E_3$ | 278.9 | 278.9 | 278.9 | 278.9 | 278.9 | 278.9 | 278.9 |
| 9 | $E_4$ | 318.9 | 338.9 | 358.9 | 378.9 | 398.9 | 418.9 | 678.9 |
| 10 | $T_4$ | 1036 | 1101 | 1166 | 1231 | 1299 | 1361 | 2205 |
| 11 | $E_5$ | 103 | 109.5 | 115.9 | 122.4 | 128.8 | 135.3 | 219.3 |
| 12 | $\eta_1$ | 67.70% | 67.70% | 67.70% | 67.70% | 67.70% | 67.70% | 67.70% |

In Table 1, Column 1 lists the variables used in the thermodynamic analyses at corresponding points of FIG. 1. Row 1 (Q) Btu/lbm is the heat transferred to cylinder gas during a combustion process. Row 2 (ϕ) is the equivalence ratio. Row 3 ($R_e$) is the selected expansion ratio for this discussion. Row 4 ($V_3$) is the cylinder clearance volume. Row 5 ($R_e$) is the compression ratio of, for example, 14.5 for obtaining the desired compression temperature. Row 6 ($V_2$) is the volume where the compression process begins with $V_2=14.14$ ft$^3$. Row 7 ($E_2$) is the internal energy at point 2, where $E_2=E_1=c_vT_1$. Row 8 ($E_3$) is the internal energy at point 3 determined by the equation $E_3=E_1(V_1/V_3)^{k-1}$. Row 9 ($E_4$) is the internal energy at the end of a combustion process 3-4, and is equal to the value in Row 8 added to the value in Row 1. Row 10 ($T_4$) is the combustion temperature at the end of the combustion process and is equal to $E_4/c_v$. Row 11 ($E_5$) is the internal energy at point 5 and is equal to $E_4(V_4/V_5)^{k-1}$. Row 12 ($n_t$) is the indicated thermal efficiency where $n_t=(E_4-E_5)/E_4$.

As previously discussed, in addition to the base design criteria, a Secondary Design Element for operating at a one-third or lower loading is to increase the indicated efficiency by about 7% because of the increased cp/cv ratio. Another Secondary Design Element is the recycling of exhaust gas. The exhaust gas at point 5 contains a large amount of unused air as well as the internal energy $E_5$. Unused air and $E_5$ is partially recovered by recycling a portion of the exhaust gas to be utilized in the next cycle. The recycling of the exhaust gases can be easily accomplished by timing the closing the exhaust valve and opening the intake valve so that a portion of the exhaust gas is forced into the intake manifold to mix with flesh air and is induced into the cylinder again with new fresh air during the ensuing intake stroke. Assuming that about one quarter of the exhaust gas can be recycled in this manner, the indicated efficiency in Row 12 ($\eta_t$) is increased by 0.667(1.0−0.667)/4.0=5.5%. The combined increase in indicated efficiency from Secondary Design Elements (on account of the increased cp/cv ratio (7%) and the exhaust gas recycling (5.5%)) is 12.5%, which increases the total indicated efficiency in Row 12 from 67.7% to 80.2%. Moreover, forcing a portion of the exhaust gas into the intake manifold reduces the flow rate and flow resistance of the intake and exhaust systems to further increase the indicated efficiency.

Traditionally, brake efficiency is defined as the indicated efficiency multiplied by the mechanical efficiency without taking into account combustion heat loss to coolant as required by the conservation of energy law. A more accurate definition of brake efficiency is the difference between the indicated efficiency and the sum of combustion loss to coolant and friction loss. Thus, the sum of combustion heat loss and friction loss is equal to the difference between the indicated efficiency and brake efficiency. Although it is very difficult to compute the exact sum of combustion loss and friction loss, the amount can be estimated and refined by test engine experiments.

Table 2 provides the brake power computations of the new four-stroke overexpanded HCSI engine designed to operate at one-third and lower loading. The friction power loss $P_a$ of a four-stroke engine at full load is about one half of combustion heat power loss. The friction power loss of a four-stroke engine at full load is equal to (0.58.7−0.25)/3=0.112 where 0.587 and 0.25 are the assumed indicated efficiency and brake efficiency, respectively. The friction power loss is proportional to designed full power. Designed at one-third load $P_f$ is equal to 0.037 (0.112/3). The combustion loss power $P_{cl}$ is equal 0.224 at full load. At one-third and lower loading, $P_{cl}$ is estimated by $P_{cl}=0.224(T_4-T_w)/(T_{cf}-T_w)$, where $T_{cf}$ is the combustion temperature at full load, and $T_w$ is the wall temperature of the combustion chamber.

TABLE 2

| | 1 | 2 | 3 | 4 | 5 | 6 | 7 | 8 |
|---|---|---|---|---|---|---|---|---|
| 1 | $Q^+$ | 40 | 60 | 80 | 100 | 120 | 140 | 400 |
| 2 | $T_4$ | 1036 | 1101 | 1166 | 1231 | 1299 | 1361 | 2205 |
| 3 | $P_{fl}$ | 0.037 | 0.037 | 0.037 | 0.037 | 0.037 | 0.037 | 0.037 |
| 4 | $P_{cl}$ | 0.038 | 0.042 | 0.045 | 0.048 | 0.052 | 0.069 | 0.1 |
| 5 | $P_i$ | 80.2% | 80.2% | 80.2% | 80.2% | 80.2% | 80.2% | 80.2% |
| 6 | $P_b$ | 72.7% | 72.3% | 72.0% | 71.7% | 71.3% | 69.6% | 66.5% |
| 7 | $P_b/25$ | 2.91 | 2.89 | 2.88 | 2.87 | 2.85 | 2.78 | 2.66 |

In Table 2, Rows 1 and 2 are taken directly from Table 1. Row 3 ($P_{fl}$) is friction loss power. Row 4 ($P_{cl}$) is the combustion loss power. Row 5 ($P_i$) is the indicated power as a percentage of fuel chemical energy. Row 6 ($P_b$) is the brake power with $P_b$=Row 5−Row (3)−Row (4). Row 7 ($P_b/25$) is the brake power ratio between the new four-stroke overexpanded HCSI engine at one-third or lower loading and a four-stroke GDI engine at full load with an assumed brake power of 25% of the fuel chemical energy. The brake power density ratio is equal to 2.66/3=0.89. Thus, to provide the equivalent power of an existing four-stroke GDI Engine operating at full load, the displacement volume of the new four-stroke overexpanded HSCI engine must be 1.12 times the displacement volume of the four-stroke GDI engine at full load or 1.06 times the cylinder diameter of the four-stroke GDI engine at full load. However, the specific fuel consumption and green house gases (GHG) emissions are reduced to less than 37% of the four-stroke GDI engine operating at full load. By operating at one third or lower equivalence ratio and eliminating the formation of NOx, the new four-stroke overexpanded HCSI engine requires lighter duty components and eliminates the need for expensive after-treatment components.

An existing four-stroke GDI engine can be easily retrofitted to a four-stroke overexpanded HCSI engine to lower the specific fuel consumption and GHG. First the cylinder clearance of the existing engine is reduced to obtain an expansion ratio of 16.0. Second, the fuel injection system is modified to limit equivalence ratios no more than 0.334. The retrofitted four-stroke GDI engine can be expected to reduce the specific fuel consumption and GHG by more than 50%.

Although an engine having a compression ratio of 14.5 and an expansion ratio of 16 is described, this is not limiting. For example, depending on operating conditions such as intake temperature and fuel type, it may be desirable to have a compression ratio between 13.5 and 15.5 or between 14 and 15. Similarly, if operating conditions change, it may be desirable to have an expansion ratio between, for example, 15 and 17 or between 15.5 and 16.5.

As previously mentioned, utilizing the Conservation of Energy Equation, the Three Ratios Methodology has identified three basic characteristics necessary to improve thermodynamic efficiency of existing internal combustion engine: (i) a compression ratio necessary to achieve a compression temperature just below the autoignition temperature of the fuel/air mixture; (ii) an equivalence ratio of no more than about 0.334 to limit combustion temperature; and (iii) a high expansion ratio. These basic characteristics have been applied to create a two-stroke version of the overexpanded HCSI engine.

With variable valve timing technology available, the four-stroke overexpanded HCSI engine can be converted into a two-stroke version. The computation of the thermodynamic performance of the two-stroke engine is similar to the performance of the four-stroke overexpanded HCSI engine (as shown in Tables 1 and 2) except that the brake power density is doubled for the two-stroke engine to reach 1.78 (2×2.66/3). Thus, to provide the equivalent power of an existing four-stroke GDI Engine operating at full load, a new two-stroke overexpanded HCSI engine operating at 0.334 equivalence or lower ratio can be downsized to 56% of the displacement volume of the four-stroke GDI engine at full load, with a specific fuel consumption only 37% of the four-stroke GDI engine.

Details of one or more embodiments are set forth in the accompanying drawings and description. Other features, objects, and advantages will be apparent from the description, drawings, and claims. Although a number of embodiments of the invention have been described, it will be understood that various modifications may be made without departing from the spirit and scope of the invention. It should also be understood that the appended drawing is not necessarily to scale, presenting a somewhat simplified representation of various features and basic principles of the invention.

What is claimed is:

1. A method for designing an internal combustion engine comprising:

selecting a compression ratio that produces a compression temperature just below the autoignition temperature of a fuel/air mixture;

selecting a fuel equivalence ratio of 0.334 or lower to meet a full range of operating requirements, wherein the fuel equivalence ratio produces a combustion temperature below the threshold temperature at which NOx formation or autoignition of the mixture occurs; and selecting an expansion ratio greater than the compression ratio.

2. The method of claim 1, further comprising calculating thermodynamic performance of the internal combustion engine between a first point and a second point in an operating cycle using a Conservation of Energy Equation: $E_2/E_1=(V_1/V_2)^{k-1}$.

3. The method of claim 1, wherein the compression ratio is selected to obtain a compression temperature ranging from 800 to 900° K.

4. The method of claim 1, wherein the fuel equivalence ratio is selected to obtain a combustion temperature below about 1600° K.

5. The method of claim 1, wherein the expansion ratio is selected to obtain an indicated efficiency greater than 50%.

6. The method of claim 1, wherein the compression ratio is between 13.5 and 15.5.

7. The method of claim 1, wherein the expansion ratio is between 15 and 17.

8. The method of claim 1, wherein the compression ratio, fuel equivalence ratio, and expansion ratio are each selected to minimize specific fuel consumption.

9. The method of claim 1, wherein the compression ratio, fuel equivalence ratio, and expansion ratio are each selected to minimize or eliminate NOx emissions.

10. An overexpanded homogeneous charge spark ignition internal combustion engine comprising:

a compression ratio that produces a compression temperature just below the autoignition temperature of a fuel/air mixture;

an expansion ratio greater than the compression ratio; and a fuel equivalence ratio of about 0.334 or lower to meet a full range of operating requirements, wherein the engine produces a combustion temperature below the threshold temperature at which NOx formation or autoignition of the mixture occurs.

11. The internal combustion engine of claim 10, wherein the compression ratio is between 13.5 and 15.5.

12. The internal combustion engine of claim 10, wherein the expansion ratio is between 15 and 17.

13. The internal combustion engine of claim 10, wherein the engine is a two stroke engine.

14. The internal combustion engine of claim 10, wherein the engine is a four stroke engine.

15. A method for operating an internal combustion engine, the method comprising:

operating an engine at a fuel equivalence ratio of about 0.334 or lower across a full range of operating requirements to produce combustion temperatures below the threshold temperature at which NOx formation or autoignition of the mixture occurs, wherein the engine comprises a compression ratio between 13.5 and 15.5 and an expansion ratio between 15 and 17, and wherein the expansion ratio is greater than the compression ratio.

16. The internal combustion engine of claim 15, further comprising recycling a portion of exhaust gas into the intake to recover a portion of the exhaust gas internal energy during an ensuing engine cycle that would otherwise be rejected from the cylinder as exhaust gas.

17. The internal combustion engine of claim 15, further comprising operating on a four stroke or a two stroke mode.

18. The internal combustion engine of claim 15, further comprising operating with a homogeneous fuel/air mixture.

19. The internal combustion engine of claim 18, further comprising igniting the homogenous fuel/air mixture with a spark to achieve homogeneous charge compression ignition-like combustion.

* * * * *